United States Patent [19]

Potoff

[11] Patent Number: 4,503,987

[45] Date of Patent: Mar. 12, 1985

[54] SCREW CAP CONSTRUCTION

[76] Inventor: Rubin Potoff, 46 Mountain Farms Rd., West Hartford, Conn. 06117

[21] Appl. No.: 614,520

[22] Filed: May 29, 1984

[51] Int. Cl.[3] ..... B65D 41/04

[52] U.S. Cl. ..... 215/329

[58] Field of Search ..... 215/329, 330, 217

[56] References Cited

U.S. PATENT DOCUMENTS

| | | | |
|---|---|---|---|
| 2,847,139 | 8/1958 | Christiansson et al. | 215/329 X |
| 2,869,747 | 1/1959 | Patterson | 215/329 X |
| 3,843,015 | 10/1974 | Blau et al. | 215/329 X |

*Primary Examiner*—Steven M. Pollard

*Attorney, Agent, or Firm*—H. Gibner Lehmann; K. Gibner Lehmann

[57] ABSTRACT

A multi-part screw cap construction for a container, comprising a thin-walled cup-like shell, an insert member having an annular side wall receivable in the shell, and a one-piece weight member constituted essentially as a single wire coil disposed completely within the shell at a location between its closed end and the end of the insert member, so as to provide a "weighted feel" to the cap. The coil is secured against looseness or vibration by suitable adhesive or cement, and the insert member can be pressed into the shell and adhered thereto by the adhesive while the latter is still tacky. The insert member is cup-like, and internally threaded for cooperation with the external threads on the neck of the container. The advantage is that an improved ornamental appearance can be imparted to the exterior surface of the shell, such as by metallizing or lacquering processes, while at the same time there can be employed relatively inexpensive components, such as economically molded plastic parts, drawn metal shells, and simple wire stock, for economy.

26 Claims, 14 Drawing Figures

24
20
36
24
36
34
20
36
22
36
34
28
30
32
26

34

34
20a
26

38
40
52

54
46
38
54
40
52
54
52
42
48
44
50

SCREW CAP CONSTRUCTION

BACKGROUND

This invention relates generally to screw cap constructions for bottles, jars or other containers, and more particularly to caps of the type employed with consumer oriented products, such as cosmetics, colognes, perfumes, or other items where decorative caps are desired for purposes of ornamentation.

In the past, ornamental caps were generally molded of one-piece plastic and their exterior surfaces suitably decorated with distinctive designs of the type including small ornamental pieces or stampings of one form or another. One popular arrangement was to employ a phenolic substance for the body of the cap, and to apply a metallizing coating to the exterior surface, giving the appearance of solid metal. This construction had the advantage of relative economy, while at the same time there was little sacrifice in attractive appearance. A shine or luster could be imparted to the surface by suitable lacquering, yielding a cap which was aesthetically pleasing and eye-catching to the consumer. In addition, the phenolic substance had a characteristic "body" or weighted feel, which tended to remove the cap from the domain of the less expensive or cheaper-appearing molded parts.

Frequently, where economical plastic substances were employed, the density of the material was such that the finished part was extremely light in weight. While such a characteristic might be considered desirable from the standpoint of storage or shipping, a lightweight "feel" gave to the consumer the impression of cheapness, and it has been found that such an initial impression had an adverse affect on the successful marketing of certain products, especially in the cosmetic field where a premium is placed on product quality and effective or attractive packaging.

SUMMARY

The above drawbacks and disadvantages of prior screw cap constructions are largely obviated by the present invention, which has for one object the provision of a novel and improved screw cap which is extremely simple in construction and economical to manufacture, while at the same time providing an unusually attractive part which presents an aesthetically pleasing impression to the consumer.

A related object of the invention is to provide an improved screw cap as above set forth, wherein overall manufacturing economy is realizeable through the use of simple and economical molded components, drawn metal parts, and readily available metal wire stock.

Still another object of the invention is to provide an improved screw cap as above characterized, wherein the time required for assembly is minimal, and wherein neither special fixtures or tools are required, nor unusual skills on the part of assembly personnel.

Yet another object of the invention is to provide an improved screw cap of the kind indicated, wherein a significantly improved product appearance is obtained, comprising exceptionally smooth surfaces, without incurring excessive manufacturing expense, either in time, equipment, or materials.

A still further object of the invention is to provide an improved screw cap in accordance with the foregoing, which has the relatively high quality, ornamental appearance and weighted feel of a metallized phenolic cap but which employs less expensive metal and cheaper molded plastic parts.

Yet another object of the invention is to provide a novel method of manufacturing an improved screw cap, the steps being especially simple and straightforward to carry out, and involving neither special tools nor equipment, nor requiring the services of specially trained personnel. The various steps lend themselves readily to mass production techniques and procedures, which reduce the overall manufacturing cost to an absolute minimum without sacrificing product quality.

The above objects are accomplished by the provision of a multi-part screw cap for a container comprising a thin-walled cup-like shell closed at one end, said shell presenting the exterior surface of the cap and having an annular side wall, comprising an insert member also having an annular side wall which is adapted to engage and fit generally within the inner surface of the wall of the shell, and comprising a one-piece weight member constituted as a single inexpensive wire coil disposed completely within the shell at a location between the closed end thereof and the insert member so as to provide a "weighted" feel to the cap. Means are provided for fixedly securing the insert member within the wall of the shell, and for securing the weight member against inadvertent loosening or rattling during subsequent use of the cap. The insert member is cup-like and has internal threads which are adapted to mate with the external threads on the neck of the container.

The objects are further accomplished by a novel and improved method of producing a multi-part screw cap of the type having an outer cup-like shell closed at one end and presenting the exterior surface of the cap, and having an annular side wall, an insert member with an annular side wall adapted to engage and fit generally within the inner surface of the annular wall of the shell and wherein the insert member is cup-like and has internal threads adapted to mate with the external threads on the neck of the container, and a one-piece weight member constituted as a single wire coil. The method further comprises the steps of applying a quantity of adhesive to the inner surface of the shell, inserting the coil into the shell such that at least some surfaces thereof come into contact with the adhesive prior to solidifying or curing of the latter, and pressing the insert member into the shell until it is fully seated and a transverse wall of the insert member comes into contact with the adhesive, such it will be held in position in the shell following sufficient curing of the same.

The arrangement is such that the finalized cap has an especially smooth and pleasing ornamental appearance while at the same time being characterized by a desirable, "weighted feel". Through suitable metallizing and lacquering procedures performed on the exterior of the shell, the impression of a "solid" highly polished metal component can be created. The expense of a phenolic plastic is thus eliminated, without sacrificing a high quality or rich appearance of the article.

Other features and advantages will hereinafter appear.

In the drawings, illustrating several embodiments of the invention:

Figures 1, 2, 3, 4, 5, 6, 7:
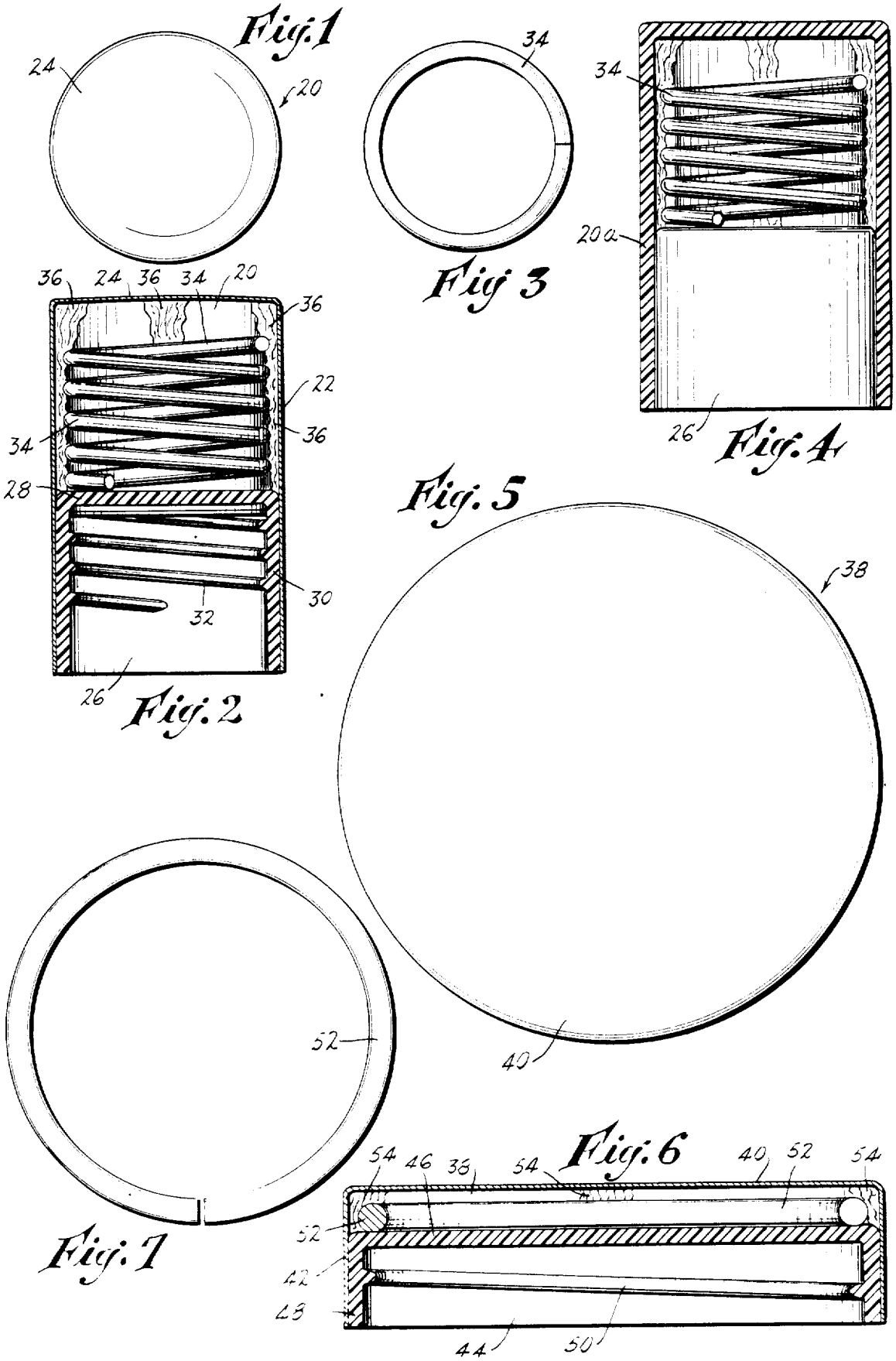
FIG. 1 is a top plan view of the improved screw cap of the present invention.
FIG. 2 is a vertical or axial section of the cap of FIG. 1.
FIG. 3 is a top plan view of the coil or weight member employed in the cap of FIGS. 1 and 2.
FIG. 4 is an axial sectional view of a screw cap made in accordance with the invention and illustrating another embodiment thereof.
FIG. 5 is a top plan view of a cap construction illustrating still another embodiment of the invention, embracing a jar cover.
FIG. 6 is an axial sectional view of the cap construction of FIG. 5.
FIG. 7 is a plan view of the weight member employed with the cap construction of FIGS. 5 and 6.

Referring first to FIGS. 1-3, the improved cap construction shown therein comprises an outer, cup-shaped shell or member 20 having a cylindrical side wall 22 and a circular top wall 24. The member 20 can be constituted of drawn sheet metal, or of molded or otherwise shaped plastic substance, with the top and side wall integral with each other.

Disposed within the outer member 20 is an inner, cup-shaped insert member 26 having a transverse wall 28 and a cylindrical side wall 30, the latter being provided with internal screw threads 32 adapted to mate with the external threads on the neck of a container (not shown) such as a bottle, for example. The inner member 26 is illustrated as being formed of plastic substance, molded in the usual manner well known in the art, and according to the invention it occupies only a portion of the interior space in the outer member 20, being preferably flush with the latter at the respective lip portions or open ends of both members.

In accordance with this invention there is provided for the purpose of imparting a solid, massive or "weighty" feel to the cap construction, a novel, inexpensive and economical-to-fabricate weight member in the unoccupied space between the top transverse walls 24 and 28 respectively of the outer and inner members, such weight member comprising a metal coil or spring of significant weight and mass, designated 34. The coil 34 is of helical configuration, with spaced-apart convolutions and random end terminations, and is characterized by a lack of critical dimensions or tolerances. It is merely required that the weight member 34 be loosely received in the outer cap member or shell 20 and have an axial length not exceeding the space between the top portions 24 and 28 of the outer and inner cap members.

Further, in accordance with the present invention, the insert or inner member 26 and the weight member 34 are fixedly secured in place within the outer cap member 20. Such securement can be effected by various means, that at present preferred being an economical application of multiple quantities of adhesive, designated 36. Such application can be done by squirting the adhesive in a single shot from multiple orifices of a nozzle, against four circumferentially-spaced inner wall surfaces of the outer member 22. Thus, in the assembly of the cap construction, after the individual formation of the three separate components comprising the members 20, 26 and 34, the outer member 20 can have the adhesive conveniently applied to it, after which the coil member 34 is put in place and then the insert or inner member 26 inserted to the required depth.

Preferably the center of gravity of the weight member lies between 20% and 80% of the distance from the closed end (wall 24) of the shell to the open end thereof, typically being on the order of 40% of this distance, as an example, to provide for a desired, optimum "feel".

Also, the adhesive is preferably of the quick-setting kind, and can be applied in a heated condition and characterized by a tacky state whereby the assembly is most easily and quickly effected with the least amount of possible malfunction. The resultant product has distinct advantages, in that the cap when being handled, has a heavy or solid feel to it which makes a favorable impression on the user or consumer, while at the same time not requiring costly substances or thick-walled structures in the fabrication, involving slow setting times or cycles. The outer member, when formed of metal, can have various desired finishes imparted to it which would not be acceptable to a plastic material. The inner member 26 can be economically fabricated in volume by known molding procedures, and the weight or coil can be run off in large quantities from plated or unplated wire stock, at low cost and without requiring any finishing operations whatsoever. The setting of the adhesive effects a reliable securement of the components, without the likelihood of looseness or rattle developing at a later date or in usage. Light-weight materials such as plastics and aluminum can be used for the inner and outer members, and the total weight of the two components can be very small while at the same time the "feel" of the cap construction is solid, or massive and substantial when held in the hand.

Another embodiment of the invention is illustrated in FIG. 4, wherein the insert or inner member and the weight member can be the same as those designated 26 and 34 above whereby they are similarly indicated by these same numerals. In the embodiment of FIG. 4 the outer member is constituted of molded plastic substance, and is indicated by the designation 20*a*. In other respects, such as by the provision of the adhesive 36 (FIG. 2) at four intervals around the inner circumference of the outer member 20*a*, the cap of FIG. 4 is similar to that of FIGS. 1-3, having the advantage of a solid or massive "feel", and giving a favorable impression to the user.

Still another embodiment of the invention is illustrated in FIGS. 5-7, depicting a larger-diameter cap such as a jar cap. In these figures the outer cup-like member is shown as being of metal, designated 38, having a circular top wall 40 and a cylindrical side wall 42. By suitable metal stamping operations such shapes can be produced in large quantities and at low cost. Disposed within the outer member 38 is an insert or inner member 44, formed of molded plastic substance, having a transverse top wall 46 and a cylindrical side wall 48. The side wall 48 has the usual screw thread 50 adapted to mate with the external screw thread of a jar (not shown) such as a cosmetic container, for example. As provided by the invention, a weight member 52 in the form of a wire coil is located in the space between the transverse walls 40 and 46 respectively of the outer and inner members. The coil 52 is shown as formed to lie in a flat plane whereby it occupies little axial space, and is actually a planar metal ring, with unconnected, abutting ends. Portions of adhesive, designated 54, can be applied to the outer member 38 as previously explained, and the assembly of the coil 52 and insert member 44 thereafter easily effected. The adhesive 54 not only secures the coil 52 against dislodgement but also cements the insert member 44, as with the previous embodiments of the invention.

Figure 8:
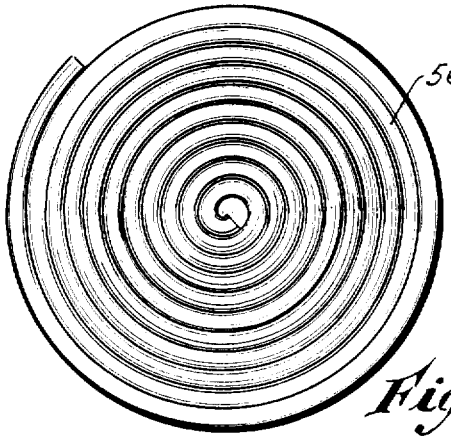
FIG. 8 is a plan view of a weight member for a screw cap according to the invention, illustrating yet another embodiment thereof.
Figure 9:
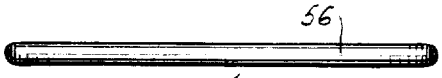
FIG. 9 is an edge elevation or view of the weight member of FIG. 8.

FIGS. 8 and 9 illustrate another embodiment of the invention, wherein the weight member is in the form of a flat spiral 56, constituted of heavy metal wire. The spiral 56 could be used to replace the coil 52 in the embodiment of FIGS. 5–7, for example, whereby the resultant cap construction would have still more added weight. Adhesive as previously explained would be used to secure the weight member 56 in the cap, as can be understood. The diameters of the coils 52 or 56 are somewhat less than the inner diameter of the shell 38 such that the coil can be readily loosely inserted or dropped into the latter, during assembly.

Figure 11:
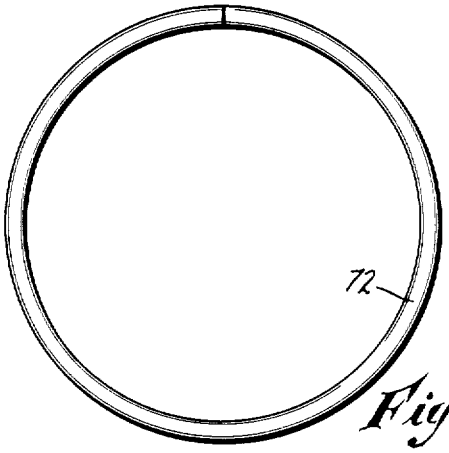
FIG. 11 is a plan view of the weight member of the cap construction of FIG. 10.
Figure 12:
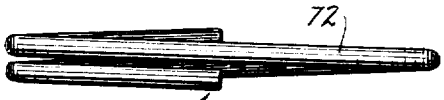
FIG. 12 is an edge elevation or view of the weight member of FIGS. 10 and 11.
Figure 10:
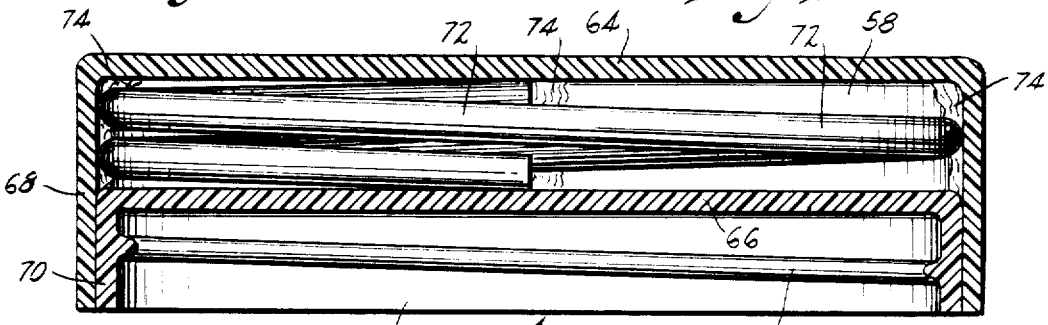
FIG. 10 is an axial sectional view of a jar cap construction made in accordance with the invention and illustrating still another embodiment thereof.

Yet another embodiment of the invention is shown in FIGS. 10–12, wherein a jar cover is constituted of inner and outer cup-shaped members both of which are of plastic substance. The outer member 58 has a plain shallow cup shape without screw threads, whereas the inner member 60 has an internal screw thread 62 for cooperation with the screw thread of the jar. The members 58 and 60 have transverse walls 64 and 66 respectively, and cylindrical side walls 68 and 70 which telescope with each other. As provided by the invention, in the space between the transverse walls 64 and 66 there is secured a weight member 72 in the form of a wire coil. Ridges of cement or glue 74 are applied to the inner surface of the outer member 58, and hold the coil 72 fixedly in place, as well as securing the inner member 60 to the outer member 58.

Figure 13:
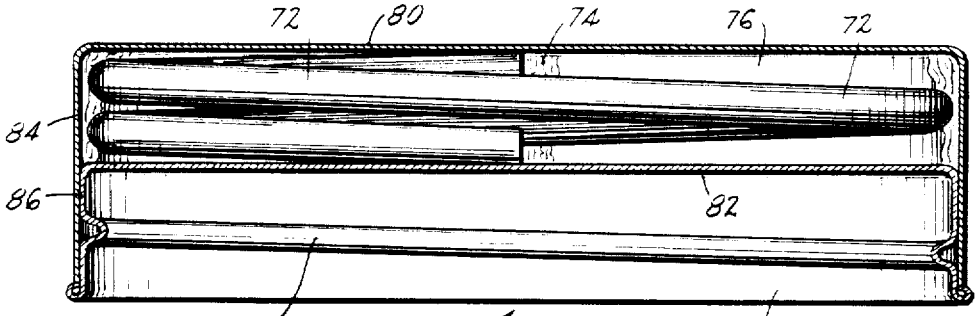
FIG. 13 is an axial sectional view of a jar cap construction illustrating yet another embodiment of the invention.

FIG. 13 illustrates a further embodiment of the invention wherein both the outer and the inner members 76 and 78 are of metal, stamped and drawn in a well-known manner and sized to telescope one in the other. The bottom edge of the inner member 78 is curled outward to act as a stop, engaging the bottom edge of the outer member 76. The members 76 and 78 have transverse walls 80 and 82 respectively, and cylindrical side walls 84 and 86. The weight member in FIG. 13 can be the same as the member 72 in FIG. 10, and has been given the same numeral. Glue or cement 74 secures in place the weight member 72, and also fixes the inner member 78 to the outer member 76. The inner member 78 has an internal rolled screw thread formation 88 for engagement with the external thread of a jar, as is understood. The edge or lip of the member 78 has an annular curl of circular cross-sectional configuration, which provides a seat for the edge or lip of the shell 80, and mostly conceals the latter. A smooth undersurface or edge is thus provided.

Figure 14:
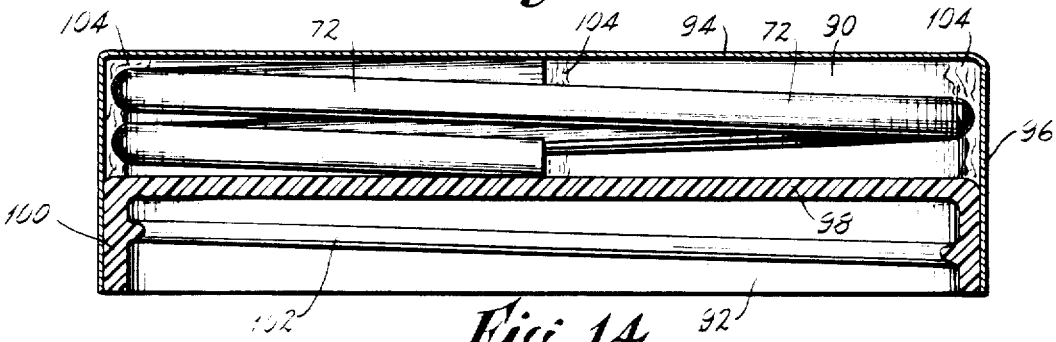
FIG. 14 is an axial sectional view of a jar cap construction illustrating still another embodiment of the invention.

Another embodiment of the invention is illustrated in FIG. 14, wherein an outer member 90 is constituted of metal, and an inner or insert member 92 is of plastic substance. The member 90 has a transverse, top wall 94 and a cylindrical side wall 96, whereas the member 92 has a transverse wall 98 and a cylindrical side wall 100, the latter being provided with a screw thread 102. The weight member 72 is disposed between the transverse walls 94 and 98 and held in place by the adhesive ridges 104, such adhesive also securing the members 90 and 92 fixedly to each other.

In each of the embodiments of the invention, separate inner and outer cap members are telescoped with each other and separated at their top portions by a wire coil weight member which gives the cap assemblage a substantial "feel" of weight or solidity, greatly improving its attractiveness to the trade and consumer. Various finishes are possible by the use of the desired materials for the cap components, and the assembly is quick and convenient by employing glue or tacky cement, preferably squirted into the outer member against the side walls thereof. The components can be mass-produced economically, whereby the overall cost is kept to a minimum.

Referring again to FIGS. 1–3, the novel method of the invention involves producing a multi-part screw cap of the type having an outer cup-like shell or member 20 closed at one end by a transverse wall 24, and having an annular side wall 22, an insert member 26 with an annular side wall engaging and fitting within the inner surface of the wall 22 of the shell 20, and a one-piece weight member 34 constituted as a single wire coil, the method further comprising the steps of applying a quantity of adhesive substance 36 to one or several locations of the inner surface of the shell 20, inserting the coil into the shell 20 such that at least some surfaces of the coil come into contact with the adhesive prior to solidifying of the same, and pressing the insert member 26 into the shell 20 until the transverse wall 28 of the insert member comes into contact with the adhesive, such that it can be held in position in the shell following sufficient curing of the same. As shown, various configurations can be employed as far as placement of the adhesive is concerned. It has been found that four locations circumferentially spaced by roughly 90° around the inner surface of the shell 20 provides satisfactory results. The adhesive is preferably applied to the shell in a liquid state, and is in a heated condition. Upon contact with the relatively cool surface of the shell, the adhesive becomes somewhat tacky, and at this point, typically within a few seconds of the application of the adhesive, the coil can be inserted or dropped into the inverted shell and into contact with the adhesive substance. Preferably the adhesive solidifies within a minute or so, and prior to this time the insert member can be pressed in to the desired position, wherein the edges or lips of the outer and inner members coincide, so as to provide a relatively smooth, finished appearance.

Referring to the embodiment of FIG. 13, wherein metal members are employed, the method of the invention involves imparting a bead or curl to the edge portion of the insert member 78, such that its lower surface presents a relatively smooth lip of curvilinear cross sectional configuration, with the sharp edge of the shell 80 resting upon the upper part of the bead or curl. This latter edge is mostly concealed by the bead, again so as to constitute a neat, finished appearance.

From the above it can be seen that there has been provided a novel and improved cap oonstruction which is extremely simple in its structure while at the same time being inexpensive to manufacture and exhibiting an especially high quality appearance and "feel" which is not normally characteristic of components constituted of sheet metal or thin molded plastic. The weight member, being constituted of round wire metal stock, can be mass-produced in large quantities and very economically, since no critical dimensions or tolerances are required, nor special finishes. The ends of the weight member can abut or come close to each other if the member lies in a single flat plane. Where the weight member is in the form of a helix, the ends will be separated an appreciable amount which again is not critical. This same is true of the spiral configuration illustrated. By the use of wire stock, no scrap results from the formation of the coil, whatsoever, whereby the basic material is used with the greatest economy. As can be readily understood, coil wire stock in all different sizes and materials is available commercially, in large quantities at extremely low cost. The assembly is seen to be readily accomplished without the need for special tools or skilled personnel. The time required is minimal, thus representing a distinct manufacturing economy.

The product and method of the invention thus constitute a distinct advance and improvement in the field of closure caps for bottles and jars.

Each and every one of the appended claims defines an aspect of the invention which is distinct from all others, and accordingly each claim is to be treated in this manner when examined in the light of the prior art devices in any determination of novelty or validity.

Variations and modifications are possible without departing from the spirit of the invention.

What is claimed is:

1. A multi-part screw cap for a container, comprising in combination:
   (a) a thin-walled cup-like shell closed at one end, said shell presenting the exterior surface of the cap and having an annular side wall,
   (b) an insert member having an annular side wall adapted to engage and fit generally within the inner surface of the annular wall of the shell, said insert member having internal threads adapted to mate with the external threads on the neck of a container,
   (c) means fixedly securing the insert member within the annular wall of the shell,
   (d) a one-piece weight member constituted as a single wire coil disposed completely within the shell at a location between the closed end thereof and the insert member so as to provide a weighted feel to the screw cap, and
   (e) means for securing said weight member to said shell against inadvertent loosening during subsequent use of the cap.

2. The invention as defined in claim 1, wherein:
   (a) the wire coil comprises a single convolution substantially all portions of which lie generally in one plane.

3. The invention as defined in claim 2, wherein:
   (a) the ends of the wire coil weight member are closely juxtaposed, and separate and distinct from each other.

4. The invention as defined in claim 1, wherein:
   (a) the wire coil comprises a multiplicity of turns,
   (b) said insert member having a transverse top wall,
   (c) one end portion of the coil being in engagement with said transverse top wall.

5. The invention as defined in claim 1, wherein:
   (a) said securing means for the weight member comprises a quantity of adhesive disposed between the outer surfaces of the coil and the inner surface of the cup-like shell.

6. The invention as defined in claim 1, wherein:
   (a) said securing means for the weight member comprises multiple individual quantities of adhesive disposed between the outer surfaces of the coil and the inner surface of the cup-like shell.

7. The invention as defined in claim 1, wherein:
   (a) the wire coil comprises a multiplicity of turns, the adjacent convolutions of which are spaced a distance from one another so as to form an expanded configuration.

8. The invention as defined in claim 1, wherein:
   (a) the center of gravity of the weight member lies in a range between 20% and 80% of the distance from the closed end of the cup-like shell to the open end thereof.

9. The invention as defined in claim 1, wherein:
   (a) the center of gravity of the weight member lies in a plane disposed approximately 40% of the distance from the closed end of the cup-like shell to the open end thereof.

10. The invention as defined in claim 1, wherein:
   (a) the wire coil comprises a multiplicity of turns, forming a spiral lying in substantially a single plane, and having a maximum diameter slightly less than that of the shell such that the coil can be dropped into the latter, with a relatively loose fit, during assembly.

11. The invention as defined in claim 10, wherein:
   (a) the ends of the wire coil weight member are disposed respectively near the inner and outer portions of the spiral, and are separate and distinct from each other.

12. The invention as defined in claim 1, wherein:
   (a) the insert member is formed of molded plastic,
   (b) the internal threads thereof being integrally formed therein.

13. The invention as defined in claim 1, wherein:
   (a) the shell is constituted of drawn metal.

14. The invention as defined in claim 1, wherein:
   (a) the insert member is constituted of metal,
   (b) said internal threads being constituted as a rolled thread formation in said insert member.

15. The invention as defined in claim 1, wherein:
   (a) the shell is constituted of drawn metal,
   (b) the insert member being constituted of metal,
   (c) said securing means for the insert member comprising an annular curl on the edge of the open end of the insert member, said curl engaging the edge of the shell so as to form a tight bead which mostly conceals the shell's edge, and
   (d) the exterior of said bead presenting a finished, smooth lip.

16. The invention as defined in claim 1, wherein:
   (a) said insert member has a transverse top wall, and
   (b) said securing means for the insert member and weight member comprising adhesive disposed in the space between the transverse wall of the insert member and the closed end of the shell.

17. A method of producing a multi-part screw cap for a container of the type having an outer cup-like shell closed at one end and presenting the exterior surface of the cap and having an annular side wall, having an insert member with an annular side wall adapted to engage and fit generally within the inner surface of the annular wall of the shell and wherein the insert member has internal threads adapted to mate with the external threads on the neck of the container, and having a one-piece weight member constituted as a single wire coil, comprising the steps of:

(a) applying a quantity of adhesive substance to the inner surface of the shell, (b) inserting the coil into the shell such that at least some of the surfaces thereof come into contact with the adhesive prior to solidifying of the latter, and (c) pressing the insert member into the shell until the transverse wall of the insert member comes into contact with the adhesive, such it can be held in position in the shell following sufficient curing of the adhesive.

18. The method as defined in claim 17, wherein:

(a) the step of applying the adhesive comprises injecting the substance into the interior of the shell along circumferentially spaced apart-locations around the inner surface thereof.

19. The method as defined in claim 17, wherein:

(a) the step of applying the adhesive comprises injecting the substance into the interior of the shell along diametrically opposed locations around the inner surface thereof.

20. The method as defined in claim 17, wherein the insert member is constituted of metal and has a cup-like configuration, and including the further step of:

(a) forming an annular curl in the edge of the insert member adjacent the open end thereof so as to form a lip on the cap having a smooth convex cross-sectional configuration.

21. The method as defined in claim 17, wherein:

(a) the adhesive is of a type which is applied in a heated condition and which cools quickly upon contact with the air, and wherein the step of inserting the coil into the shell is carried out within several seconds of the application of the adhesive to the inner surface of the shell.

22. The method as defined in claim 17, wherein:

(a) the adhesive is of a type which is applied in a heated condition and which cools and quickly becomes tacky upon contact with the air, and wherein the step of inserting the coil into the shell is carried out during a time when the adhesive achieves the said tacky consistency.

23. The method as defined in claim 22, wherein:

(a) the insert member is pressed into the shell while the adhesive is still in a tacky condition.

24. The invention as defined in claim 1, wherein:

(a) the wire coil comprises substantially two complete convolutions, each convolution extending through an angle on the order of 360°.

25. The invention as defined in claim 1, wherein:

(a) the shell is formed as a molded plastic cup.

26. The invention as defined in claim 1, wherein:

(a) the wire coil comprises a helix, (b) the ends of the helix being spaced apart axially from each other.

* * * * *